US007993253B2

(12) United States Patent
Fernandez

(10) Patent No.: US 7,993,253 B2
(45) Date of Patent: Aug. 9, 2011

(54) AGILITY DEVICE

(75) Inventor: Juan Fernandez, Towaco, NJ (US)

(73) Assignee: Products of Tomorrow, Inc., Montville, NJ (US)

( * ) Notice: Subject to any disclaimer, the term of this patent is extended or adjusted under 35 U.S.C. 154(b) by 0 days.

(21) Appl. No.: 12/380,087

(22) Filed: Feb. 24, 2009

(65) Prior Publication Data

US 2009/0215597 A1 Aug. 27, 2009

Related U.S. Application Data

(60) Provisional application No. 61/067,323, filed on Feb. 27, 2008.

(51) Int. Cl.
*A63B 22/14* (2006.01)

(52) U.S. Cl. ..... 482/146; 482/34

(58) Field of Classification Search ..... 482/146, 482/79–80, 148, 142, 139, 51, 92, 121–123, 482/126, 129–130, 34; 446/220
See application file for complete search history.

(56) References Cited

U.S. PATENT DOCUMENTS

| | | | | |
|---|---|---|---|---|
| 6,422,983 | B1 * | 7/2002 | Weck | 482/147 |
| 6,554,753 | B1 * | 4/2003 | Weck et al. | 482/147 |
| 6,575,885 | B1 | 6/2003 | Weck | |
| 6,719,676 | B1 | 4/2004 | Hsu | |
| 6,723,030 | B1 | 4/2004 | Chen | |
| 6,945,920 | B1 | 9/2005 | Kemery | |
| 7,112,168 | B2 | 9/2006 | Dalebout | |
| 7,288,055 | B2 * | 10/2007 | Blaum | 482/142 |
| 7,621,861 | B1 * | 11/2009 | Kalember et al. | 482/147 |
| 7,645,221 | B1 * | 1/2010 | Curry | 482/148 |
| 2007/0184953 | A1 * | 8/2007 | Luberski et al. | 482/146 |
| 2007/0207906 | A1 | 9/2007 | Blaum | |

FOREIGN PATENT DOCUMENTS

| | | |
|---|---|---|
| WO | WO/01/24887 | 4/2001 |
| WO | WO/03/088887 | 10/2003 |

* cited by examiner

*Primary Examiner* — Lori Baker
(74) *Attorney, Agent, or Firm* — Gearhart Law, LLC

(57) ABSTRACT

The agility device is an article of manufacture comprising a base, a stabilized inflatable support disposed on the base, and a top platform positioned on the stabilized inflatable support. The device also has optional handles and expandable base supports for added stability. The device is primarily for use as an exercise device, but also has value as an agility training tool to help users improve their balance and agility, and to improve their reflexes. It is useful for exercise, physical therapy, and for entertainment.

19 Claims, 11 Drawing Sheets

100

100

AGILITY DEVICE

CLAIM OF PRIORITY

This application claims priority to U.S. Ser. No. 61/067,323 filed Feb. 27, 2008,the contents of which are fully incorporated herein by reference.

FIELD OF THE INVENTION

The invention relates to the field of exercise equipment, in particular devices used for agility improvement.

BACKGROUND OF THE INVENTION

The present invention relates to exercise equipment, in particular that equipment used in agility training.

In recent years, many people have realized the importance of exercising to maintain good health. While many traditional exercises can greatly benefit a person, traditional exercises often fail to develop certain muscles or certain groups of muscles. In particular, traditional exercise devices often fail to provide exercise for many of the less prominent muscles. Furthermore, certain traditional exercises fail to significantly enhance balance or other coordination skills.

A good workout can provide exercise and strengthening of the core muscles in the body, including muscles in the abdominal, gluteus, and central regions of the body. Exercise devices and exercise training programs have been developed to fulfill the need for a more complete body workout, including a workout related to the core muscles. Full body training devices often have a weight system or other type of resistance system that uses a number of cables, pulleys, and benches. However, these full body trainers are often bulky and often have intricate parts that make them expensive to buy, inconvenient to store, and difficult to use.

Recently, balancing devices have been developed that are capable of strengthening the core muscles while simultaneously training the user to balance. Some of these devices, among others, have a platform mounted on a rounded chamber. The user stands on the platform or chamber and performs exercises. Cords connected to the base of the balancing device provide resistance for performing exercises such as arm curls.

Exercising on such a balancing device can develop balancing skills, coordination skills, and core muscles. In particular, devices that use an inflatable bladder require an additional element of balance because as the user applies force to one foot, the bladder flexes and transfers some of that force to the other foot.

Other balancing/exercise devices have been developed for recreation and/or exercise that provide an unstable surface on which an individual balances. One such type of device provides an unstable surface through the use of a cylinder that is free to roll on the ground. A board is placed on top of the cylinder and balance is tested as an individual stands on top of the board and attempts to prevent either of the opposing ends of the board from touching the ground. While this balancing device provides an unstable surface, movement of the board is limited to a side-to-side motion.

Another type of balancing device that provides an unstable surface on which to test balance includes a board that pivots about a vertical fulcrum that is connected to a base, which remains stationary on the ground. Balance is tested as an individual stands on top of the board and attempts to prevent any portion of the board from touching any portion of the base. Such balancing devices may allow an individual to increase or decrease the angle along which the board is allowed to pivot prior to touching the base. However, an adjustment mechanism that modifies the pivot angle of the board generally requires the board to be raised or lowered.

Platform "wobble boards" and "rocker boards" are used to develop muscle strength, endurance, coordination and improve balance by training the nervous system and improving muscular responses to perturbed or unstable joint positions. The novice or unfit user may start using the device for range of motion control in a seated or non-weight bearing position. As the user becomes proficient in controlling the rocking motion of the platform in different planes (front/back, right/left oblique angles etc.), the attachment can achieve wobble movements in all directions (360°).

To be effective the device must have a degree of instability that provokes a quick muscle response. The device is intended to be useful for beginners all the way up to highly athletic individuals due to the inherent versatility of the device and options for increasing the difficulty level. For instance, the user may make the task more difficult or challenging by standing on one foot at a time and/or by closing the eyes.

It has proven useful to increase the difficulty level as proficiency is obtained which has previously required multiple devices. Each device is often costly but required by the user if they desire to improve beyond certain introductory levels. Additionally, the devices are cumbersome to travel with such as taking them to an exercise facility or on vacation. The devices also require storage space in the user's home which is often at a premium.

U.S. Pat. No. 6,422,983 teaches an inflatable device that can be used for physical therapy, conditioning or training. The device has a support platform and a flexible member. The flexible member is affixed to, and has a bowl-shaped distention projecting from, one side of the platform. This flexible member is inflatable to a pressure for supporting a person. The device is inflated before placing at least some of the weight of a person on the device. When the person wishes to later change the characteristics of the device, the pressure in the inflatable device can be changed to change its stability.

U.S. Pat. No. 6,554,753 teaches a balancing device that has a base and an inflatable flexible portion wherein the center of the inflatable portion is higher than the edges. The device is used by placing the base on the floor and standing and moving on the bladder.

U.S. Pat. No. 6,719,676 teaches an inflatable elastic exercising device that includes a deflatable collapsible elastic body and a base seat composed of assembled outer frames and reinforcing boards. The elastic body is formed with a fixing flange. The thickness of the fixing flange plus the thickness of the reinforcing board is just the height of a restricting channel of the outer frame, so that the reinforcing boards and the elastic body can be firmly fixed and enclosed by the outer frames. A user can stably and safely stand on it for doing balance exercise. After the elastic body is deflated and collapsed and the reinforcing boards and the outer frames are disassembled and stacked, it can be stored in a narrow space and conveniently transported.

U.S. Pat. No. 6,723,030 teaches an angle-adjustable exerciser that comprises a base, an adjustment disk set and a support plate. The base attaches to a spherical cast piece on top and a plate with large surface at bottom. At the periphery of the spherical cast piece, there is an adjustment disk set composed of the first disk, the second disk and a few screws. At center of the first and second disks, there are holes for the disks to install at the periphery of the cast piece. At the corresponding position, there are several through holes at the first and second disks, so the disks can be connected by at least two positioning screws. The distance between the disks is maintained by positioning screws. Another through hole is for an adjustable screw to tighten or loosen the disks. This is also to adjust the declined angle for the adjustment disk set on the spherical cast piece.

U.S. Pat. No. 6,945,920 teaches a balancing board allowing for selection of a desired degree of stability. The balancing board has a platform and a hemispherical fulcrum slidably mounted to platform and bifurcated into a pair of pivot members. Each pivot member is independently positionable along an underside of the platform opposite of an engagement surface upon which a user positions themselves to practice balancing training techniques. When the pivot members are slid together, the balancing board is freely pivotable about any axis in the plane of the surface on which the pivot members are resting. Conversely, when the pivot members are spaced apart from each other, the balancing board resists pivoting in a direction aligned with the axis along which the pivot members are slidable.

U.S. Pat. No. 7,112,168 teaches balancing equipment that provides a selectively dynamic platform for an individual thereon. The weight and movement of the individual causes the platform to tilt in any direction, thereby attempting to throw off the balance of the individual, causing the individual to work on maintaining balance while on the dynamic platform. The dynamic nature of the platform can be adjusted to correspond to the balancing abilities of individuals. An adjustment mechanism increases or reduces the amount the platform is able to tilt, without requiring the raising or lowering of any component of the platform. An exercise mechanism can also be connected to the platform to further modify the dynamic nature of the platform.

US Publication 20070207906 and U.S. Pat. No. 7,288,055, teach a balance and exercise apparatus comprising a base member supported on an underlying stratum, pivoting member positioned on a base member, and a body support member positioned on top of the pivot member, the body support member secured to the base member by a combination of a plurality of resilient tension cords and non-resilient cinch strap thus allowing the user to either stand, lie or sit on the body support member and cause the body support member to selectively tilt from a horizontal plane about 360 degrees of orientation.

International Publication WO/2003/088887 teaches a proactive machine that is used for assessing and improving a user's proprioception. The machine has a tilting platform upon which the user stands, a non-rotating tilting means connected to the platform for tilting the platform along a first axis and along a second axis perpendicular to the first axis, and a control means for controlling the tilting means.

U.S. Pat. No. 6,575,885 and International Publication WO/2001/024887 teach an inflatable device that can be used for physical therapy, conditioning or training. The device has a support platform and a flexible member. The flexible member is attached or affixed to, and has a bowl-shaped distension projecting from one side of, the platform. This flexible member is inflatable to a pressure for supporting a person. The device is inflated in order to support at least some of the weight of a person by compressing the inflatable device at or adjacent to its center. When the person wishes to later change the characteristics of the device, the pressure in the inflatable device can be changed to change its stability.

The current invention employs a top platform on a semi-spherical inflatable support, which rests on a base. The top platform and base are connected using a set of restraining straps. The use of a semi-sphere allows the desired movement that a sphere would provide, but with greater stability to the user.

The present invention encompasses many of the advantages described in the prior art, but also has advantages that the prior art lacks. For instance, in addition to improving balance, coordination, and reflexes, the Agility Device provides two-fold muscle toning function. The use of this product, whether for exercise or balance training, will force both to take place. If a user employs the product for exercise purposes, the intrinsic nature of the device will force the user to focus on and improve their balance and related skills. Alternatively, if the user employs the unit for balance improvement, the sudden shifts in body weight and position caused by motions required for the control of balance will force certain muscle groups to work and will result in exercise and muscle toning.

In addition to exercise and the improvement of balance, coordination and reflexes, the Agility Device may be used for entertainment. For example, with the integration of sensors and transmitters, the Agility Device could be used in conjunction with a gaming system. A user's location, movement, and actions could be measured, read, interpreted, and transmitted to an interactive game on any electronic device, including but not limited to, hand-held devices such as I-Pods, cellular phones or Nintendo DS systems, stationary devices such as Nintendos, X-Boxes or Play Stations, or any device of the user's choice.

One activity that lends itself to this function is dancing, either for general exercise, muscle strengthening, training, or for fun. In addition, multiple users in different physical locations could interact through linked electronic devices to stage contests, synchronized exercise, etc. Other sports/activities that the Agility Device is effective in training for include, but are not limited to, skiing, snowboarding, surfing, any roller sport (such as roller blading), ice skating, or any sport where balance is key to the function.

The Agility Device could be used in exercise classes, either as part of a routine or as an entire work-out session. It could also be used in classes similar to "spinning" classes, where instead of the traditional bicycle being ridden to a video of bike trails, the Agility Device is used to simulate sports and situations such as, but not limited to, skiing down a mountain, surfing on an ocean, or ice skating on a lake, by employing the device while viewing the appropriate video. It could also be used conjunction with virtual reality games.

One advantage of the present invention is the allowance for an interchangeable top platform for various uses, exercises, or positions. For instance, one configuration may include, but not be limited to, a contour that resembles a saddle to simulate riding an animal. Another embodiment of the top platform may include, but not be limited to, different textures or contours on each side for differing uses, exercises or positions.

An additional embodiment may include, but not be limited to, the addition of a recessed area in the top platform. The recessed area could be empty or could contain an insert such as, but not limited to, foam or non-slip material to cushion the user during use and absorb some force as well as act as an anti-slip surface. The insert could contain a logo, other promotional language or image, or any language or image desired, such as a person's name or other item. The recessed area also has the advantage, with or without the insert, of acting as a boundary through the raised edge of its perimeter. This boundary may prevent the user from accidentally sliding or slipping off of the device.

Another advantage, of particular use to beginners or users who are conducting exercises with the device for rehabilitation purposes, is the addition of handles that can move or can be made stationary. The handles allow for a safer and more stable mount and dismount, as well as adding a feature that helps maintain balance during use. The handles may lock into place or may be moveable to allow for upper body exercise while using the device. The handles could be moved while exercising the lower body, or the user could stand with the legs stationary and use the handles alone for upper body exercise, for instance while resting the legs between sets of lower body exercise.

The addition of stationary handles (handles in the 'locked' position) to the agility device is a major advantage over many of the devices described in the prior art, particularly for users with poor balance skills. The use of handles facilitates achieving the desired skill improvement yet reduces the potential for injuries that can occur from falling while exercising with the device. As the skill level builds, the user can unlock the handles and use them for upper body exercise as desired. As the skill level continues to build, the user can use the device without handles if desired.

The agility device employs a stabilized inflatable support that can be inflated to any desired firmness. This allows the level of intensity of the exercise to be varied according to the user's desire, by adjusting the inflation volume of the support. Thus, when a person who is unskilled in using the device wishes to exercise, they may inflate the support to a differing degree than the skilled athlete would. The fill volume of the support can be modified as the user's skill level increases. Additionally, a gauge may be added to provide measurement of the degree of fill for tracking purposes.

Other advantages include the addition of expandable base supports, so the device base is more likely to stay stationary while the user is moving on the agility device. This also allows a greater range of motion on the top platform and adds to the safety of the device, particularly for novices. For the nervous beginner, the addition of the expandable base supports also aids a feeling of stability.

Ease of operation and storage are additional advantages of the agility device. The agility device can be manufactured with an integral pump that can be used manually or electronically to easily inflate and deflate the stabilized inflatable support. Alternatively, the pump can be removable, but can easily be stored with the device due to a pump storage cavity in the base of the device.

The stabilized inflatable support portion of the device can be fused into the base for stability, and for ease of transport and storage. The support can be deflated entirely and the handles can be made to fold around the base of the agility device, thus forming a compact cylinder that can be stored in a small space and transported easily.

Preferred embodiments of this invention are illustrated in the accompanying drawings and will be described in more detail herein below.

SUMMARY OF THE INVENTION

The invention is an article of manufacture, comprising: a base, a stabilized inflatable support disposed on the base; and a top platform positioned on the stabilized inflatable support.

The invention is designed to be used as an exercise device. In addition, the invention may be employed by users who want to improve their balance and agility, or for entertainment purposes.

It is an object of the invention to provide a device for exercise.

It is an object of the invention to assist in muscle toning and weight loss.

It is an object of the invention to provide a device to assist in improving balance, coordination, and reflexes.

It is an object of the invention to provide safety features such as handles and an expandable platform on an agility device.

It is an object of the invention to assist in rehabilitation after an injury.

It is an object of the invention to provide a device for entertainment.

It is an object of the invention to provide entertainment in the area of dance and to improve dancing skills.

It is an object of the invention to be used for entertainment in conjunction with video and gaming systems.

It is an object of the invention to provide a device to allow users to improve snowboarding, skiing, or skills in any sport that requires balance.

It is an object of the invention to provide a means to adjust the level of difficulty of use of the device.

It is an object of the invention to provide a device that stores and transports easily.

It is an object of the invention to provide a device with interchangeable top platforms to increase the versatility of use.

DESCRIPTION OF THE PREFERRED EMBODIMENTS

Figure 1:
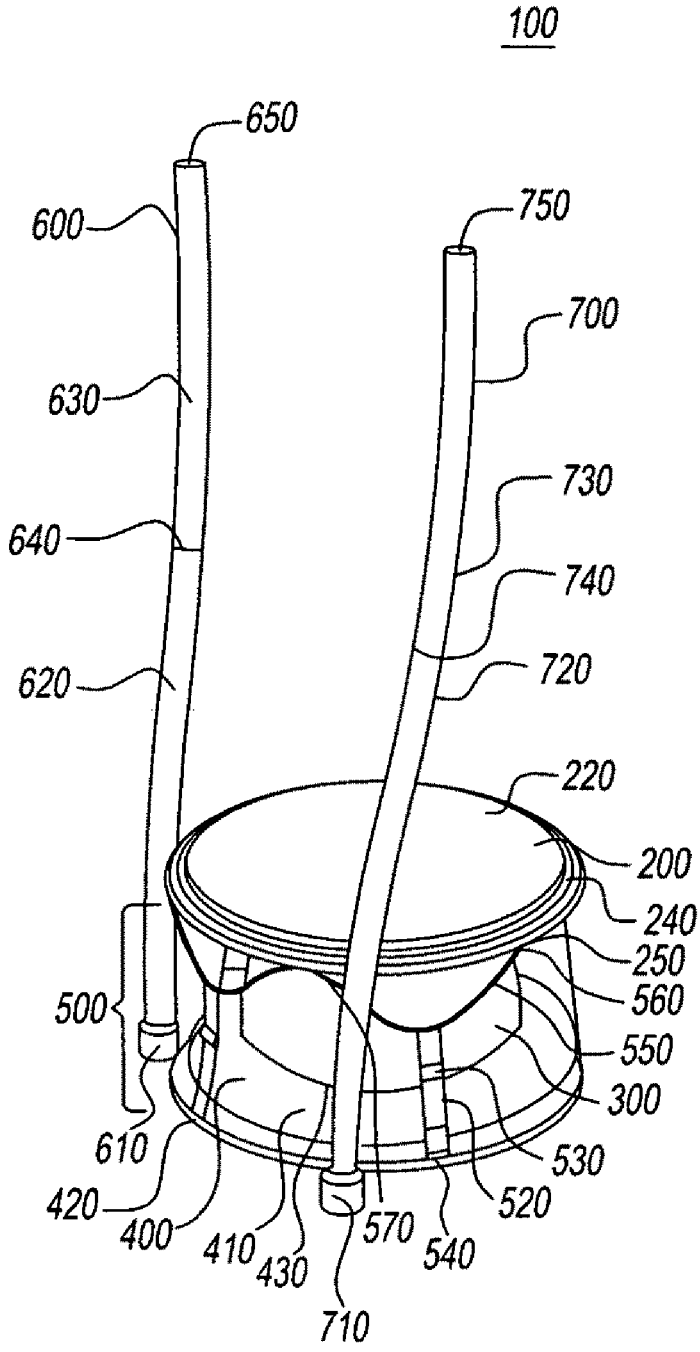
FIG. 1 is a perspective view of the invention showing the agility device with handles.

The preferred embodiments of the present invention will now be described with reference to FIGS. 1-14 of the drawings. Identical elements in the various figures are identified with the same reference numerals.

FIG. 1 is a perspective view of the invention, showing a preferred embodiment in which the agility device 100 has handles. FIG. 1 illustrates the agility device 100 with a top platform 200, a stabilized inflatable support 300, a base 400, a restraining strap 500, a first handle 600, and a second handle 700.

The top platform 200 has a top surface 220, an outer edge 240, and a tension band attachment 250. The base 400 has a top surface 410, a bottom surface 420, and a base support containment 430 which holds the stabilized inflatable support 300. The top platform 200 may removably connect with the base 400 when the stabilized inflatable support 300 is deflated.

Although the agility device top platform 200 and base 400 are shown as circular in shape in the illustrative drawings, they can be any shape, including but not limited to: circular, square, rectangular, star, polygon, triangular, and diamond. Further, the top platform 200 and base 400 can be the same shape or two different shapes. The preferred shape of the top platform 200 and of the base 400 is either round or oval, with a diameter of 10 cm to 1000 cm, with the preferred diameter 40-100 cm. In the preferred embodiment, the top platform 200 and base 400 are the same shape and size, but they can be different shapes and sizes. The height of the or thickness of the top platform 200 could be 0.1 cm to 50 cm, with a preferred range of 2-6 cm. The height of the base 400 could be 1 cm to 100 cm, with the preferred height 10-20 cm. The diameter of the inflatable stabilized support 300 when fully inflated could be 5 cm to 500 cm, with a preferred diameter of 40-60 cm.

The base 400 may be may be solid or hollow. If the base 400 is hollow, it may have an opening to allow the introduction of a stabilizing material, including but not limited to, any dense material, such as water or sand.

The restraining strap 500 holds the top platform 200 and the base 400 together, with the stabilized inflatable support 300 contained between the top platform 200 and the base 400. The restraining strap 500 has an adjustment strap 520, an adjustment strap buckle 530, an adjustment strap attachment 540 for attaching the strap to the base 400, and a tension band 550 which has a first end 560 and a second end 570 that attach to the top platform 200.

Any number of restraining straps 500 may be used in the device, and they may be anchored permanently or removably to the base 400 or to the top platform 200 using any type of fastener deemed suitable, including but not limited to being welded or fused on with heat, or being glued to one or both of the base 400 or top platform 200. The restraining strap may also be fastened by, but not limited to, hooking, snapping or attaching to the agility device using hook and loop fasteners.

In the preferred embodiment, the adjustment strap attachment 540 is a permanent attachment to the base, and the tension band 550 is permanently attached at first end 560 and second end 570 to the top platform 200. In this embodiment each restraining strap 500 has a tension band 550. The adjustment strap buckle 530 is opened completely to thread the tension band 550 through the adjustment strap 520, then the adjustment strap buckle 530 is closed. The adjustment strap 520 is then adjusted to the desired tautness. The preferred number of restraining straps 500 per device is four and it is preferred for the restraining straps to be spaced at equidistant intervals.

Another embodiment would be to use the adjustment strap 520 without the tension band 550, and to anchor the adjustment strap 520 to both the top platform 220 and the base 400. In this embodiment, all of the restraining straps 500 could be attached without a tension band 550, or one or more of the restraining straps 500 could have the tension band 550 while the others lacked the tension band 550.

The adjustment strap 520 may be attached to the tension band 550 permanently or removably. The adjustment strap 520 may be attached to the mid point of the tension band 550 or may be attached at any other point on the tension band 550. The adjustment strap 520 may be attached to the tension band 550 by threading the tension band through as described above, or it may be attached by any other means, such as but not limited to, gluing, sewing, or heat fusing.

In the embodiment illustrated in FIG. 1, the agility device 100 has a first handle 600 and a second handle 700 disposed on the base in first handle mount 610 and second handle mount 710 respectively. First handle 600 has a first handle bottom post 630 connected to a first handle top post 630 by a first handle post swivel 640. It also has a first handle end 650. Second handle 700 has a second handle bottom post 720 connected to a second handle top post 730 by a second handle post swivel 740. It also has a second handle end 750.

As can be seen in FIG. 1, the handles 600 and 700 are seated on the base 400 in the handle mounts 610 and 710. The handles can be used with device or can be removed from the base 400, and they can be removably or permanently attached to the agility device 100. Alternately, the agility device 100 may have only one handle, either permanently affixed or removably seated in a handle mount. The handle mounts may be anywhere on the agility platform, including but not limited to, on the base 400 or top platform 200, and there may be any number of mounts to allow more versatility in handle placement. In addition, the handle mounts may be moveable, so that the user may place them in any desired position relative to the device. Further specifics of the handles will be discussed in reference to FIG. 7.

The components of the agility device may be manufactured from any suitable substance or combination or amalgam of substances, including but not limited to: plastic, including but not limited to thermoplastics, acrylics, polystyrenes, vinyl, polypropylenes, or any suitable plastic; rubbers, including but not limited to natural gum rubber and synthetic rubbers, including but not limited to elastomers, thermoplastic elastomers, silicone rubber, butyl rubber, polybutadiene rubber; glass materials including but not limited to fiberglass, plexiglass, borosilicate; cloth, including but not limited to leather, nylon, canvas, cotton, rayon, polyester, bamboo, elastic and elastane; wood; paper, including but not limited to paperstock and cardboard; metals and metal composites, including but not limited to steel, stainless steel, brass, copper, aluminum, and iron. In addition, any of these materials may be combined in any method or form to yield the desired material, and composites of any of these materials may be used. Different materials may be used on different parts of the agility device. The preferred materials for different components are described below.

Polypropylene or polyethylene are preferred for the top platform 200 and base 400. Foam (plastic or rubber) or rubber are preferred for the insert for the top platform 200. Heavy duty rubber such as Krylon or PVC is preferred for the inflatable stabilized support 300. Nylon webbing is preferred for the adjustment strap 540, and heavy duty rubber is preferred for the tension band 550.

Figure 2:
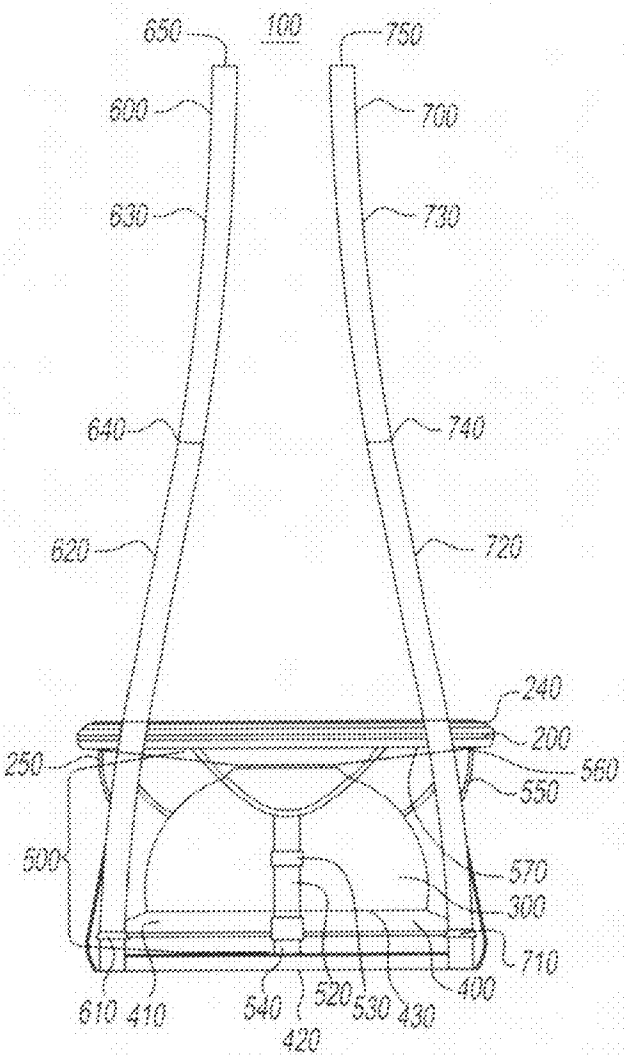
FIG. 2 is a front view of the invention showing the agility device with handles.

FIG. 2 is a front view of the invention showing a preferred embodiment in which the agility device 100 has handles. FIG. 2 illustrates the agility device 100 with a top platform 200, a stabilized inflatable support 300, a base 400, a restraining strap 500, a first handle 600, and a second handle 700.

The top platform 200 has outer edge 240 and a tension band attachment 250. The base 400 has a top surface 410, a bottom surface 420, and a base support containment 430 which holds the stabilized inflatable support 300.

The restraining strap 500 holds the top platform 200 and the base 400 together, with the stabilized inflatable support 300 contained between the top platform 200 and the base 400. The restraining strap 500 has an adjustment strap 520, an adjustment strap buckle 530, an adjustment strap attachment 540 for attaching the strap to the base 400, and a tension band 550 which has a first end 560 and a second end 570 that attach to the top platform 200.

In the embodiment illustrated in FIG. 2, the agility device 100 has a first handle 600 and a second handle 700. First handle 600 has a first handle mount 610, a first handle bottom post 620, a first handle top post 630, a first handle post swivel 640, and a first handle end 650. Second handle 700 has a second handle mount 710, a second handle bottom post 720, a second handle top post 730, a second handle post swivel 740, and a second handle end 750.

Figure 3:
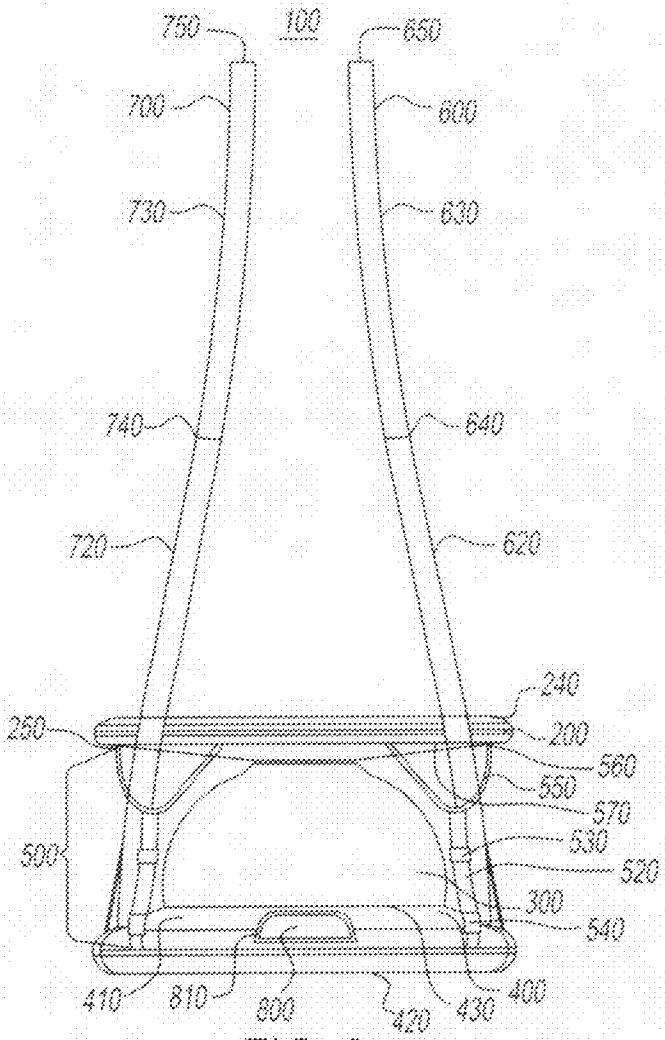
FIG. 3 is a back view of the invention showing the agility device with handles.

FIG. 3 is a back view of the invention showing a preferred embodiment in which the agility device 100 has handles. FIG. 3 illustrates the agility device 100 with a top platform 200, a stabilized inflatable support 300, a base 400, a restraining strap 500, a first handle 600, a second handle 700, and a pump 800.

The top platform 200 has outer edge 240 and a tension band attachment 250. The base 400 has a top surface 410, a bottom surface 420, and a base support containment 430 which holds the stabilized inflatable support 300.

The restraining strap 500 holds the top platform 200 and the base 400 together, with the stabilized inflatable support 300 contained between the top platform 200 and the base 400. The restraining strap 500 has an adjustment strap 520, an adjustment strap buckle 530, an adjustment strap attachment 540 for attaching the strap to the base 400, and a tension band 550 which has a first end 560 and a second end 570 that attach to the top platform 200.

In the embodiment illustrated in FIG. 3, the agility device 100 has a first handle 600 and a second handle 700. First handle 600 has a first handle mount 610, a first handle bottom post 620, a first handle top post 630, a first handle post swivel 640, and a first handle end 650. Second handle 700 has a second handle mount 710, a second handle bottom post 720, a second handle top post 730, a second handle post swivel 740, and a second handle end 750.

FIG. 3 also shows that the base 400 has a pump cavity 810 suitable for containing a pump 800. The pump 800 may be, but is not limited to, a manually operated bellows type of pump or a motor/compressor type of pump if electronic. In the case of the manual pump, the pump 800 may be built into the base 400 and will be manually pumped while in the base by a lever or plate which will be stepped on repeatedly, or the pump may be stored in the cavity and removed to manually pump and inflate the stabilized inflatable support 300. In the case of an electronic pump, the pump 800 may be located inside the base 400 and may be integral to the base, or it may be a separate part that has to be inserted or connected into the base. The power cord or power supply for the electronic pump may be detachable or integral, and the power cord may be retractable into the base. Although the pump and pump cavity are shown as rectangular, they can be any suitable shape and dimension.

Figure 4:
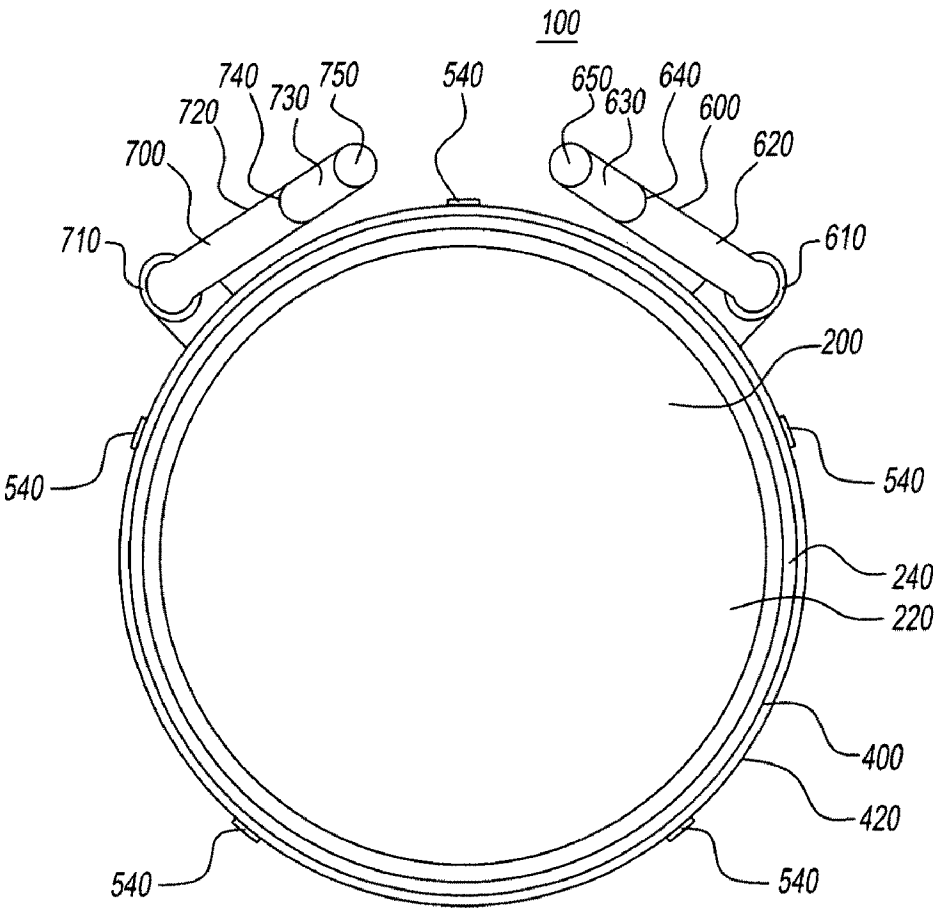
FIG. 4 is a top view of the invention showing the agility device with handles.

FIG. 4 is a top view of the invention showing the agility device with handles. The top platform 200 has a top surface 220 and an outer edge 240. The base 400 has a bottom surface 420.

The adjustment strap attachment 540 for attaching the strap to the base 400 can be seen in FIG. 4, as can first handle 600 and second handle 700. First handle 600 has a first handle mount 610, a first handle bottom post 620, a first handle top post 630, a first handle post swivel 640, and a first handle end 650. Second handle 700 has a second handle mount 710, a second handle bottom post 720, a second handle top post 730, a second handle post swivel 740, and a second handle end 750.

Figure 5B:
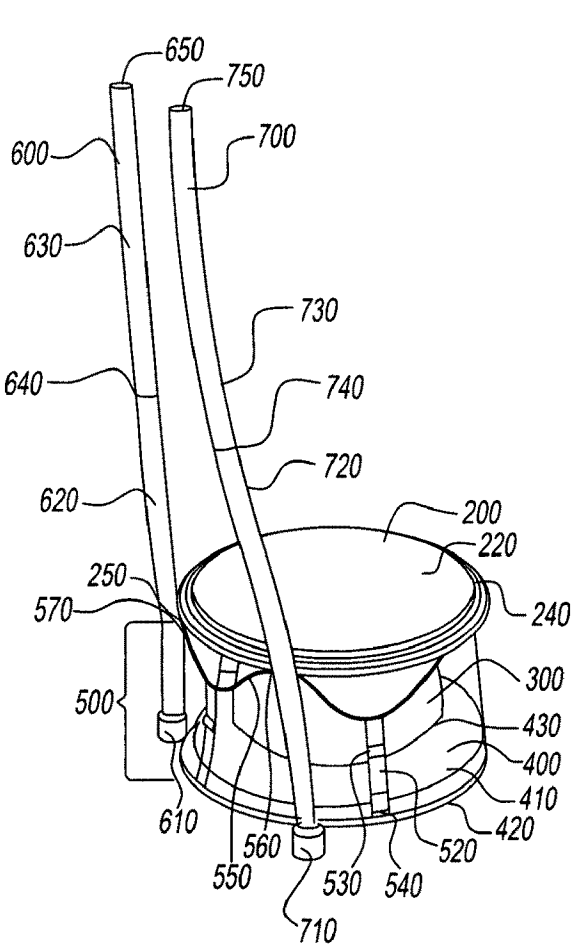
FIG. 5B is a perspective view of the invention showing one embodiment of the present invention having the orientation of the handles away from the top platform.
Figure 5A:
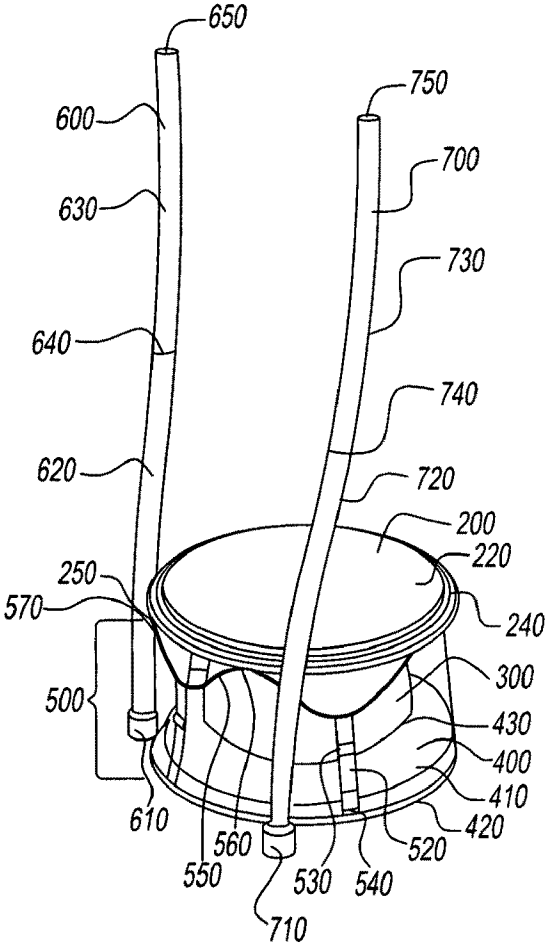
FIG. 5A is a perspective view of the invention showing one embodiment of the present invention having the orientation of the handles towards the top platform.

FIGS. 5A and FIG. 5B are perspective views of the invention showing different orientations of the handles. FIG. 5A and FIG. 5B illustrate the agility device 100 with a top platform 200, a stabilized inflatable support 300, a base 400, a restraining strap 500, a first handle 600, and a second handle 700. FIG. 5A shows one embodiment of the present invention wherein the handles are oriented towards the top platform. FIG. 5B shows one embodiment of the present invention wherein the handles are oriented away from the top platform.

The top platform 200 has a top surface 220, an outer edge 240, and a tension band attachment 250. The base 400 has a top surface 410, a bottom surface 420, and a base support containment 430 which holds the stabilized inflatable support 300.

The restraining strap 500 holds the top platform 200 and the base 400 together, with the stabilized inflatable support 300 contained between the top platform 200 and the base 400. The restraining strap 500 has an adjustment strap 520, an adjustment strap buckle 530, an adjustment strap attachment 540 for attaching the strap to the base 400, and a tension band 550 which has a first end 560 and a second end 570 that attach to the top platform 200.

In the embodiments illustrated in FIGS. 5A and FIG. 5B, the agility device 100 has a first handle 600 and a second handle 700. First handle 600 has a first handle mount 610, a first handle bottom post 620, a first handle top post 630, a first handle post swivel 640, and a first handle end 650. Second handle 700 has a second handle mount 710, a second handle bottom post 720, a second handle top post 730, a second handle post swivel 740, and a second handle end 750. FIGS. 5A and FIG. 5B show the handles in two positions in order to illustrate that the handles can be moved by the user to provide upper body exercise or a more comfortable handle position for the user.

Figure 6B:
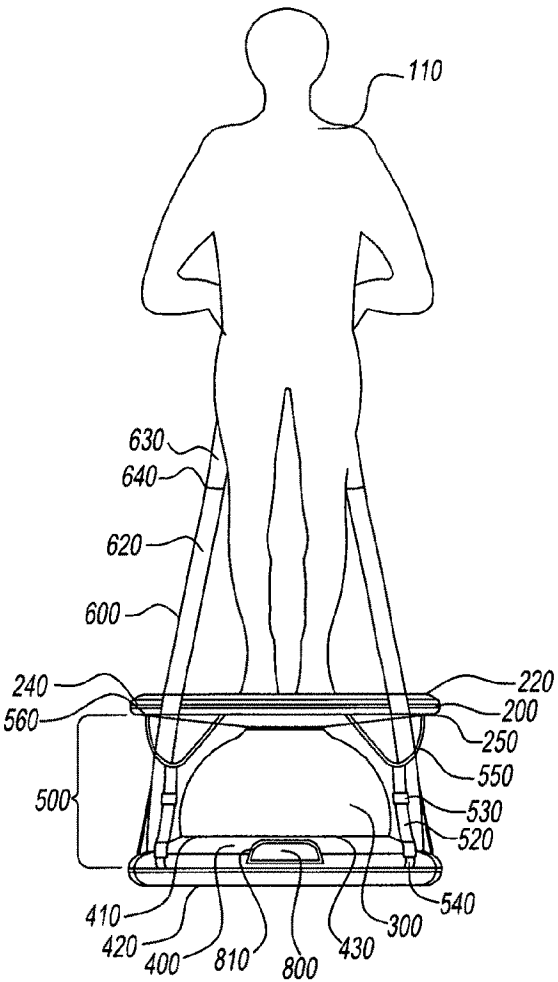
FIG. 6B is a rear view of the invention showing the agility device in use by a person.
Figure 6A:
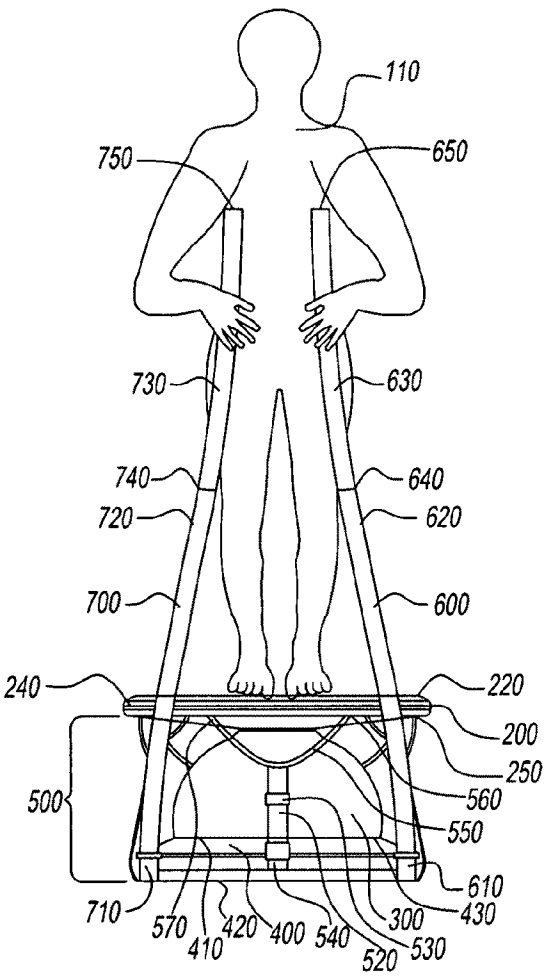
FIG. 6A is a front view of the invention showing the agility device in use by a person.

FIGS. 6A and FIG. 6B are perspective views of the invention showing the agility device 100 in use by a person 110. FIG. 6A shows the front view of the invention in use. FIG. 6B shows the rear view of the invention in use. FIGS. 6A and FIG. 6B illustrate the agility device 100 with a top platform 200, a stabilized inflatable support 300, a base 400, a restraining strap 500, a first handle 600, a second handle 700, and a pump 800.

The top platform 200 has outer edge 240 and a tension band attachment 250. The base 400 has a top surface 410, a bottom surface 420, and a base support containment 430 which holds the stabilized inflatable support 300.

The restraining strap 500 holds the top platform 200 and the base 400 together, with the stabilized inflatable support 300 contained between the top platform 200 and the base 400. The restraining strap 500 has an adjustment strap 520, an adjustment strap buckle 530, an adjustment strap attachment 540 for attaching the strap to the base 400, and a tension band 550 which has a first end 560 and a second end 570 that attach to the top platform 200.

In the embodiments illustrated in FIG. 6A and 6B, the agility device 100 has a first handle 600 and a second handle 700. First handle 600 has a first handle mount 610, a first handle bottom post 620, a first handle top post 630, a first handle post swivel 640, and a first handle end 650. Second handle 700 has a second handle mount 710, a second handle bottom post 720, a second handle top post 730, a second handle post swivel 740, and a second handle end 750. FIG. 6B also shows the pump 800 and the pump cavity 810.

Figure 7:
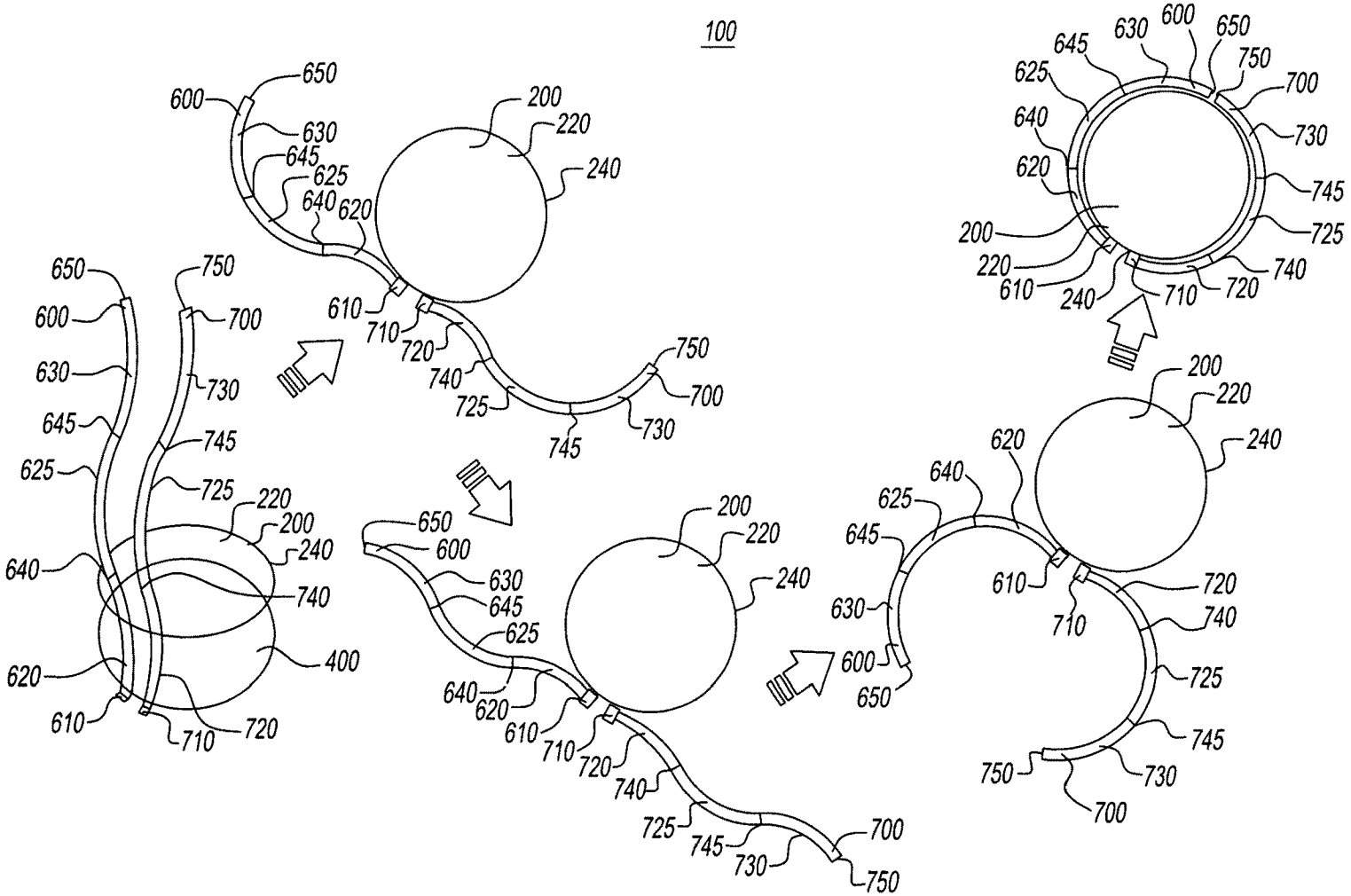
FIG. 7 is a top view of the agility device showing how the handles may be folded in a manner that allows invention to be configured for easy storage.

FIG. 7 depicts a top view of the agility device 100 showing how the handles 600 and 700 may be formed in a manner that allows the invention to be configured for easy storage. FIG. 7 depicts an embodiment of the present invention wherein each handle 600 and 700 may be folded around the base 400. The agility device 100 is shown with the top platform 200 which has a top surface 220 and an outer edge 240; the base 400; the first handle 600 and the second handle 700.

In this embodiment the handles are each made of three interlocking parts that can be twisted together to form one continuous handle. These interlocking parts twist at different angles as necessary to achieve the desired effect when the device is in use, and then are twisted to conform to the shape of the base 400 when storage of the device is desired. The handle sections are joined together by tapering each post so they have a male and female end; the male and female ends are joined to make one continuous handle. The handles also twist or swivel at the point where the posts join. The diameter of the handles may be 0.5 cm to 15 cm, with a preferred diameter of 2.5-7.5 cm. The length of the handles may be 10 cm to 500 cm, with a preferred overall height of 100-200 cm for handles in use. Although the invention is illustrated with multi-post handles, it may be manufactured either with multiple interlocking posts or with each handle as one piece. If manufactured with interlocking posts, any number of posts may be used, although the preferred number of posts is three.

First handle 600 has a first handle mount 610, a first handle bottom post 620, a first handle post swivel 640, a first handle middle post 625, a second first handle post swivel 645, a first handle top post 630, and a first handle end 650. Second handle 700 has a second handle mount 710, a second handle bottom post 720, a second handle post swivel 740, a second handle middle post 725, a second second handle post swivel 745, a second handle top post 730, and a second handle end 750.

Figure 8:
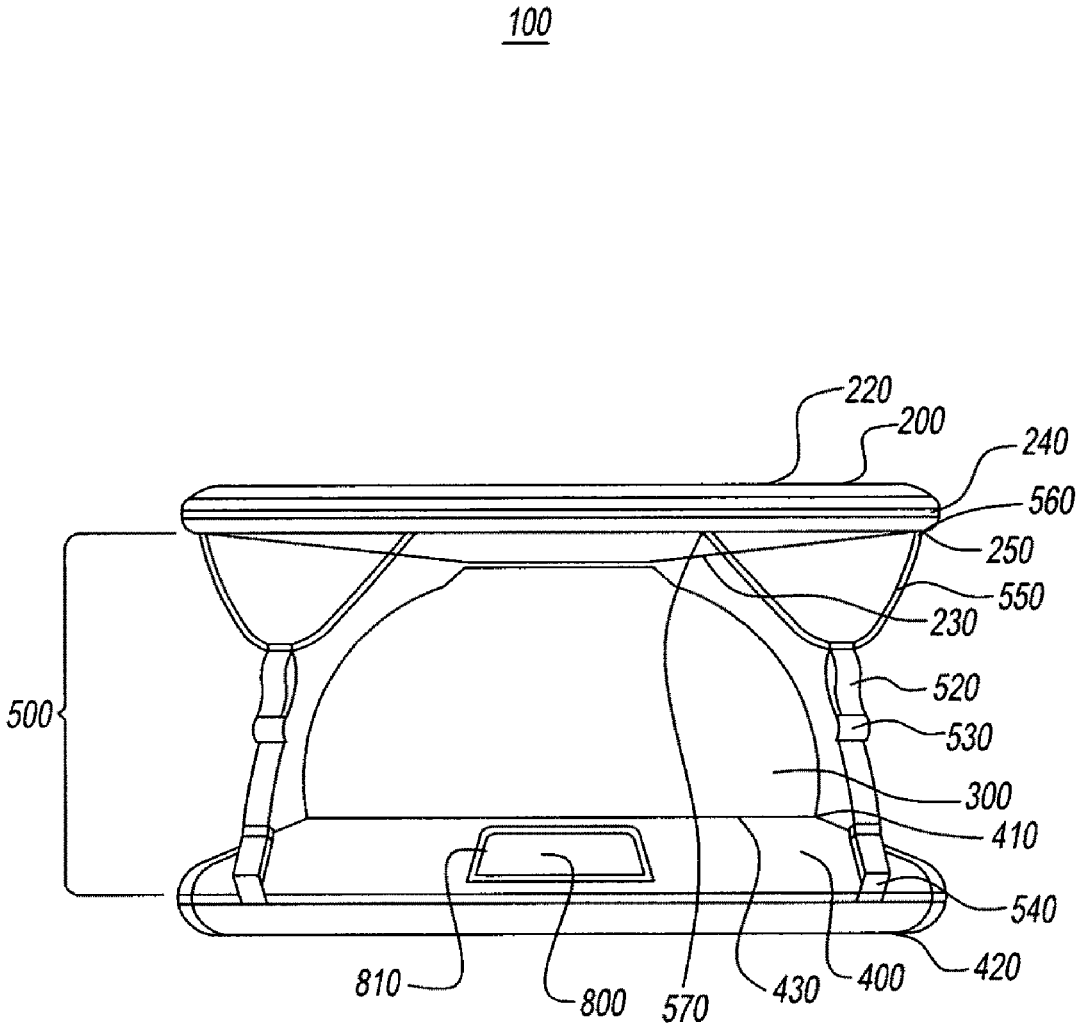
FIG. 8 is a back view of another embodiment of the invention showing the agility device without handles. This view also shows the option for inflating the stabilized inflatable support.

FIG. 8 is a back view of another embodiment of the invention showing the agility device 100 without handles. This view also shows the option for inflating the stabilized inflatable support. FIG. 8 illustrates the agility device 100 with a top platform 200, a stabilized inflatable support 300, a base 400, a restraining strap 500, and a pump 800.

The top platform 200 has a top surface 220, an outer edge 240, and a tension band attachment 250. The base 400 has a top surface 410, a bottom surface 420, and a base support containment 430 which holds the stabilized inflatable support 300.

The restraining strap 500 holds the top platform 200 and the base 400 together, with the stabilized inflatable support 300 contained between the top platform 200 and the base 400. The restraining strap 500 has an adjustment strap 520, an adjustment strap buckle 530, an adjustment strap attachment 540 for attaching the strap to the base 400, and a tension band 550 which has a first end 560 and a second end 570 that attach to the top platform 200. FIG. 8 shows the pump 800 and the pump cavity 810.

Figure 9:
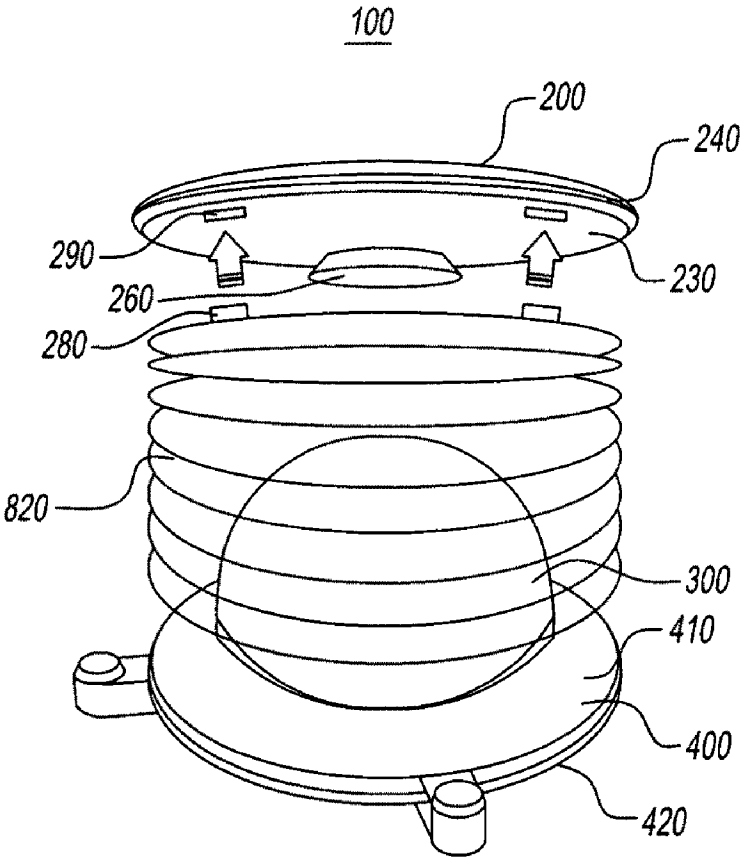
FIG. 9 is an exploded view of the agility device, showing the base, the stabilized inflatable support, the bellows, and the top platform.

FIG. 9 is an exploded view of the agility device 100, showing the base 400 with base top surface 410 and base bottom 420; the stabilized inflatable support 300, and the bellows 820. FIG. 9 also shows the top platform 200 with underside 230, outer edge 240, top platform attachment 260, bellow attachment 280, and bellow attachment slot 290. FIG. 9 illustrates the use of a bellows 820 that surrounds the stabilized inflatable support 300, and that is disposed between the underside of the top platform 230 and the top surface of the base 410. FIG. 9 shows a bellows that adds protection to the stabilized inflatable support and also adds aesthetic value to the agility device. The bellows also allows the device to be customized by the user, by having a unique color or a section to allow the user to write their name or identifier on the outside of the bellows. FIG. 9 also shows the top platform with a top platform attachment 260 that allows it to rest more securely on the stabilized inflatable support 300 for added security. The diameter of the top platform attachment 260 may be 0.5% to 98% of the diameter of the top platform 200, with the preferred dimension for the diameter of the top platform attachment 260 being 25-50% of the diameter of the top platform 200.

Although the stabilized inflatable support is illustrated as a semi-sphere in FIG. 9 and the other drawings, it can be any suitable shape, including but not limited to, a semi-sphere, a sphere, a cube, a cylinder, an inverted pyramid, or any three dimensional polyhedron. The preferred shape is a semi-sphere.

Figure 10:
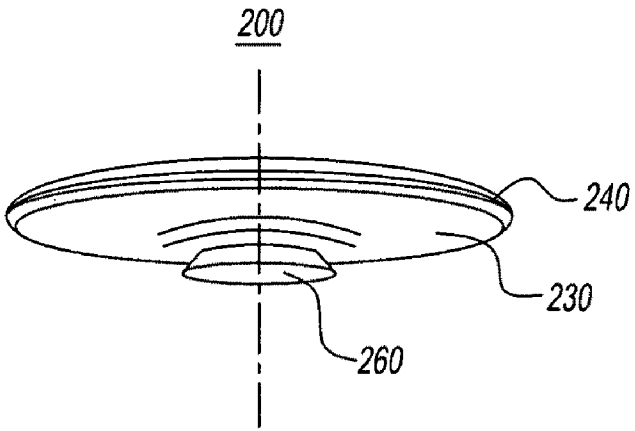
FIG. 10 is a perspective view of the top platform of the agility device showing the platform attachment.

FIG. 10 is a perspective view of the top platform 200 showing the platform attachment 260. The top platform 200 has an underside 230 and an outer edge 240.

FIGS. 9 and 10 also illustrate the means for attaching the top platform 200 to the stabilized inflatable support 300 by using the platform attachment 260. The platform attachment 260 can be attached to the stabilized inflatable support 300 by means including but not limited to, friction, or by fastening using means including but not limited to, snapping, hook and eye fastener, gluing, heat fusing, or any method deemed suitable.

Figure 11B:
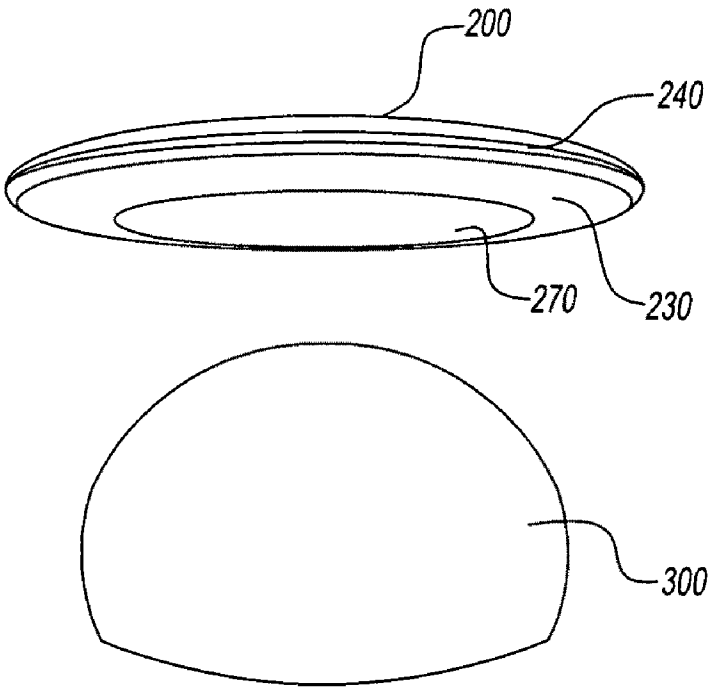
FIG. 11B shows an embodiment of the present invention wherein the top platform is a disc having a top platform cavity on the underside which conforms to the shape of the top of stabilized inflatable support.
Figure 11A:
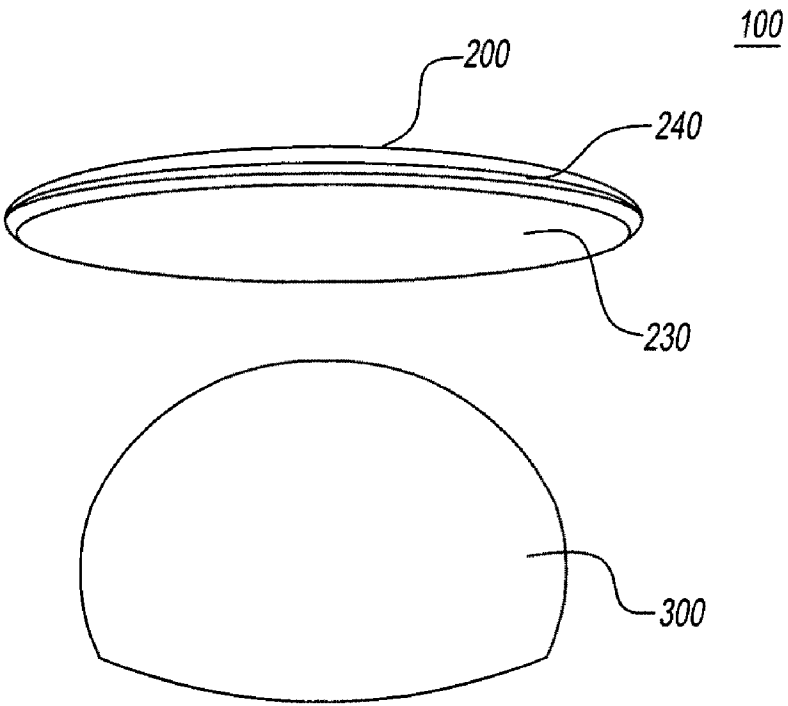
FIG. 11A shows an embodiment of the present invention wherein the top platform is a disc.

FIG. 11A and FIG. 11B are embodiments of the invention showing the stabilized inflatable support 300 separate from the top platform 200, which has an outer edge 240, and an underside 230. FIG. 11A shows an embodiment of the present invention wherein the top platform 200 is a disc. FIG. 11B shows an embodiment of the present invention wherein the top platform 200 is a disc with a top platform cavity 270 on the underside 230, and the top platform cavity 270 conforms to the shape of the top of stabilized inflatable support 300. The cavity embodiment is meant to stabilize the top platform on the stabilized inflatable support.

Figure 12:
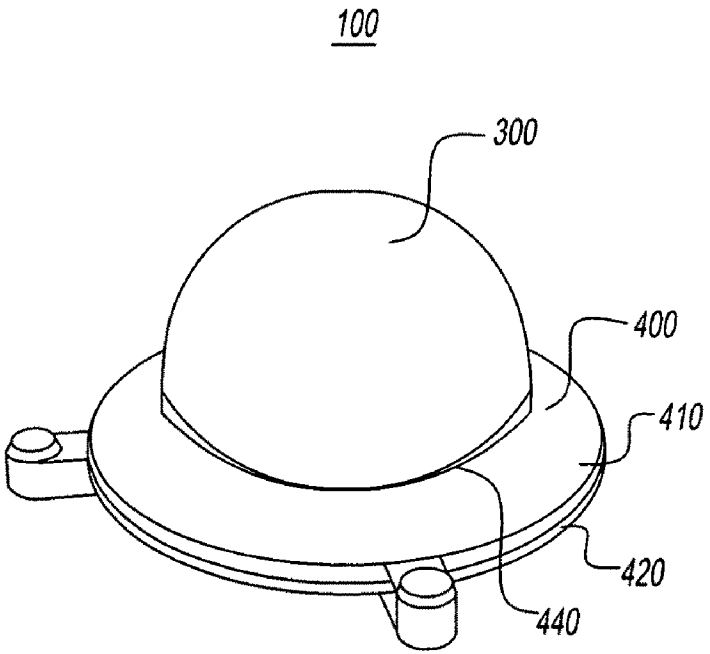
FIG. 12 is a view of the base permanently attached to the stabilized inflatable support.

FIG. 12 is a view of a stabilized inflatable support 300 that is integral with the base 400. The base 400 has a top surface 410, a base bottom 420, and a base support containment wall 440. This embodiment allows for easier transport as well as greater stability for the user.

Figure 13:
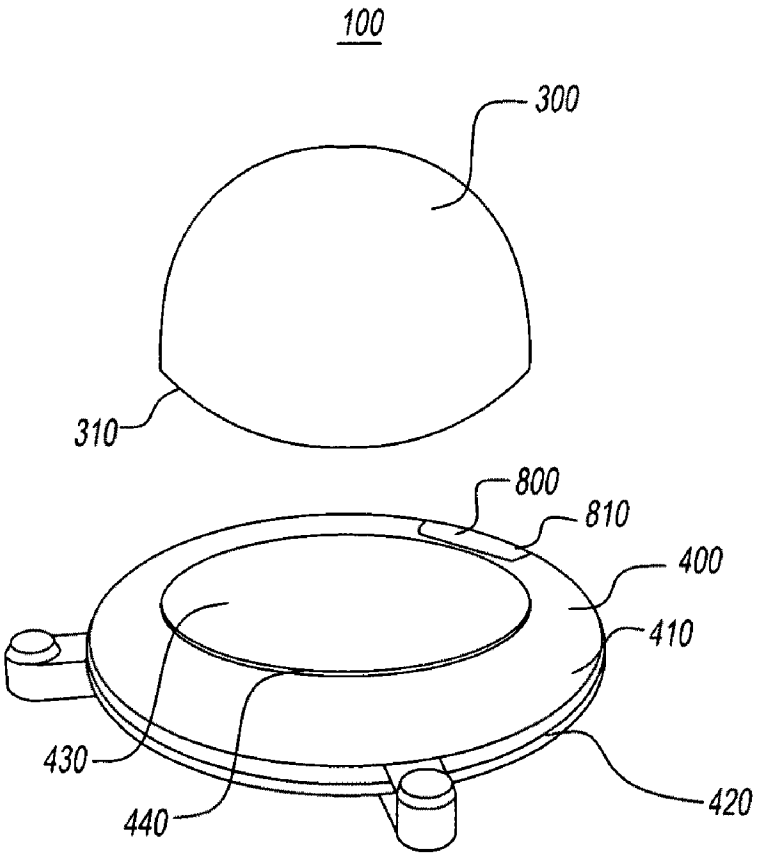
FIG. 13 is a view of an embodiment in which the base is detachable from the stabilized inflatable support. This view also shows an option for inflating the stabilized inflatable support.

FIG. 13 is a view of an embodiment in which the stabilized inflatable support 300 has a bottom 310 and may be removed from the base 400. A removable feature of the base is advantageous for storing the device and for expanding the range of exercises. It also allows for varying stabilized inflatable supports to be installed in the agility device for varying exercises, and allows ease of replacement of the stabilized inflatable support should it become damaged. This view also shows an option for inflating the stabilized inflatable support. The base 400 has a top surface 410, a base bottom 420, a base support containment 430, and a base support containment wall 440. FIG. 13 also shows a pump 800 and a pump cavity 810.

The stabilized inflatable support 300 may also be affixed to the base 400 using a method, such as but not limited to, a restraining mechanism such as a net that covers the ball and attaches to the base, or adhesion, such as but not limited to, permanent gluing or sonically welding the stabilized inflatable support 300 to the base 400 or to an intermediary member such as a plate or other suitable means that allows for the joining process.

Figure 14B:
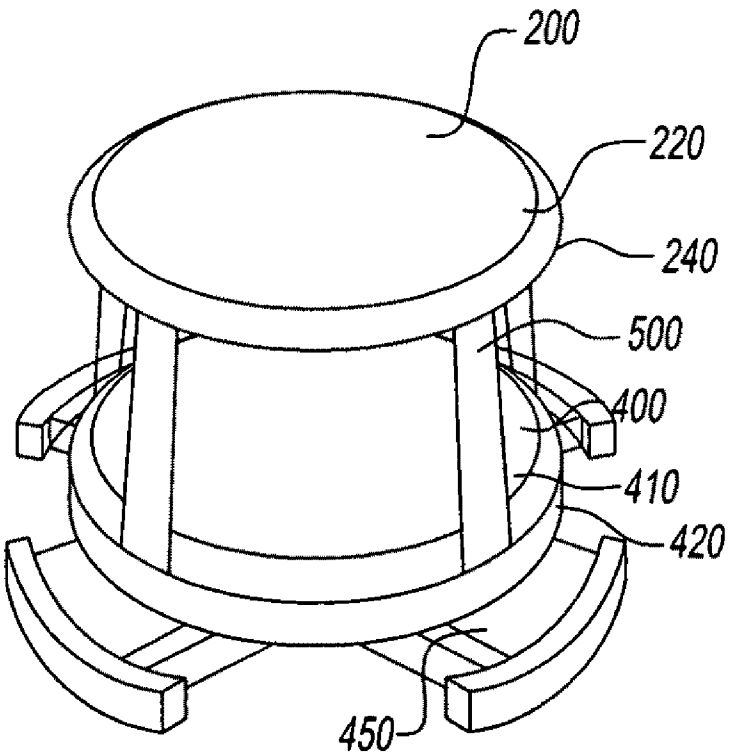
FIG. 14B is a perspective view showing the agility device with expandable base supports in an open position.
Figure 14A:
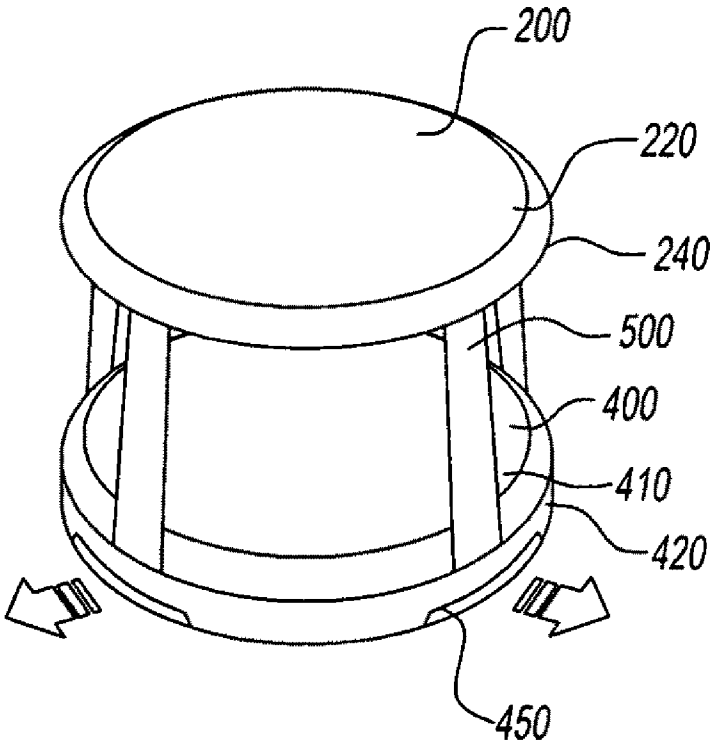
FIG. 14A is a perspective view showing the agility device with expandable base supports in a closed position.

FIGS. 14A and 14B are perspective views showing the agility device 100 with base 400 with expandable base supports 450. FIGS. 14A and 14B show the invention with a top platform 200, which has a top surface 220 and an outer edge 240. Also shown in FIG. 14A is the base 400, which has a base top surface 410, a base bottom 420, and expandable base support 450. The restraining strap 500 is also shown in FIGS. 14A and 14B. The expandable base support 450 functions to add stability to the device when in use, if needed or desired by the user. Any number of base supports 450 can be used, but the preferred number is three supports disposed at equidistant intervals around the base 400. FIG. 14A is a perspective view showing the agility device with expandable base supports in a closed position. FIG. 14B is a perspective view showing the agility device with expandable base supports in an open position.

Although this invention has been described with a certain degree of particularity, it is to be understood that the present disclosure has been made only by way of illustration and that numerous changes in the details of construction and arrangement of parts may be resorted to without departing from the spirit and the scope of the invention.

I claim:

1. An article of manufacture, comprising:
a base,
wherein the base has at least one handle disposed on the base;
the at least one handle having a top post and a bottom post and the top post and the bottom post are connected with a post swivel;
the at least one handle having an arcuate shape;
a stabilized inflatable semi-spherical support disposed on the base;
a top platform positioned on the stabilized inflatable support; and
wherein the top platform is attached to the stabilized inflatable support with a platform attachment.

2. The article of claim 1, wherein the stabilized inflatable support has a bottom and may be removed from the base.

3. The article of claim 1, wherein the stabilized inflatable support is integral with the base.

4. The article of claim 1, wherein the stabilized inflatable support is affixed to the base.

5. The article of claim 1, wherein the top platform is attached to the stabilized inflatable support.

6. The article of claim 1, wherein the base has at least two restraining straps, wherein each restraining strap has first and second ends, and the first end of each strap is attached to the base, and the second end of each strap is attached to the top platform.

7. The article of claim 6, wherein each restraining strap has tension band.

8. The article of claim 1, wherein the base has a cavity suitable for containing a pump.

9. The article of claim 1, further comprising a pump.

10. The article of claim 1, wherein the base has at two handles disposed on the base.

11. The article of claim 1, wherein the at least one handle may be removed from the base.

12. The article of claim 1, wherein the at least one handle may be folded around the base.

13. The article of claim 1, wherein the base has an expandable base support.

14. The article of claim 1, wherein the top platform removably connects with the base when the stabilized inflatable support is deflated.

15. The article of claim 6, wherein the base has four restraining straps.

16. The article of claim 6, wherein a tension band has first and second ends, and the first and second ends are attached to the top platform, and a adjustment strap having first and second ends, is attached to the base at the first end and the second end of the adjustment strap is attached to a mid point of the tension band.

17. The article of claim 1, wherein the top platform has an underside and the base has a top surface, and a bellow is disposed between the underside of the top platform and the top surface of the base.

18. An article of manufacture, comprising:
a base having at least one handle disposed on the base,
the at least one handle having a top post and a bottom post and the top post and the bottom post are connected with a post swivel;
the at least one handle having an arcuate shape;
wherein the at least one handle may be folded around the base;
an inflatable support disposed on the base;
a top platform positioned on the inflatable support; and
wherein the top platform is attached to the stabilized inflatable support with a platform attachment.

19. An article of manufacture, comprising:
a base, having an expandable base support,
an inflatable support disposed on the base;
at least one handle being disposed on the base,
the at least one handle comprising interlocking parts that can be twisted together to form a continuous handle;
the interlocking parts of the handle being twistable at different angles;
the interlocking parts of the handle having a male and female end;
the male end and the female end of the handle being joined to make one continuous handle;
a top platform positioned on the inflatable support; and
wherein the top platform is attached to the stabilized inflatable support with a platform attachment.

* * * * *